US009509073B2

(12) United States Patent
Hsu

(10) Patent No.: US 9,509,073 B2
(45) Date of Patent: Nov. 29, 2016

(54) ELECTRICAL CONNECTOR ASSEMBLY WITH LOCKING MEMBER

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/724,233

(22) Filed: May 28, 2015

(65) Prior Publication Data

US 2015/0349442 A1 Dec. 3, 2015

(30) Foreign Application Priority Data

May 28, 2014 (TW) ..... 103209308 U

(51) Int. Cl.
*H01R 12/70* (2011.01)
*H01R 12/71* (2011.01)
*H01R 13/629* (2006.01)

(52) U.S. Cl.
CPC ..... *H01R 12/7076* (2013.01); *H01R 12/716* (2013.01); *H01R 13/62933* (2013.01)

(58) Field of Classification Search
USPC ..... 439/68, 73, 331, 487; 361/719
See application file for complete search history.

(56) References Cited

U.S. PATENT DOCUMENTS 5,647,756 A * 7/1997 Twigg ..... G01R 1/0433 439/331
6,735,085 B2 * 5/2004 McHugh ..... H01L 23/4093 24/458
7,566,237 B2 * 7/2009 Gattuso ..... H01L 23/4093 439/331
7,666,021 B2 * 2/2010 Ma ..... H01L 23/4093 439/331
7,988,459 B2 * 8/2011 Ulen ..... H05K 7/1053 439/331
8,562,367 B2 * 10/2013 Yokoyama ..... G01R 1/0466 439/331
9,118,141 B2 * 8/2015 Yeh ..... H01R 13/533
2008/0057765 A1 * 3/2008 Hsiao ..... H05K 7/1061 439/259
2008/0153338 A1 * 6/2008 Ju ..... H01R 12/7076 439/331
2010/0144190 A1 * 6/2010 Yokoyama ..... H05K 7/1061 439/487
2010/0261371 A1 * 10/2010 Morinari ..... G01R 1/0483 439/331
2010/0289513 A1 * 11/2010 Hsieh ..... G01R 1/0458 324/755.07
2010/0291793 A1 * 11/2010 Hsieh ..... H05K 7/1053 439/487

* cited by examiner

*Primary Examiner* — Alexander Gilman
(74) *Attorney, Agent, or Firm* — Wei Te Chung; Ming Chieh Chang

(57) ABSTRACT

An electrical connector assembly comprises a first connector, and a second connector mounted onto the first connector, a frame surrounding the connectors, a locking member, and a lever assemble the locking member to the frame. The locking member has a main body pivoting to the frame, a supporting portion being seated by the lever and a pushing portion. The main body locks the second connector, a user can press the lever to make the locking member to rotate, then to release the second connector, and upwardly push the second connector to apart the second connector from the first connector.

19 Claims, 11 Drawing Sheets

ELECTRICAL CONNECTOR ASSEMBLY WITH LOCKING MEMBER

BACKGROUND OF THE INVENTION

1. Field of the Invention

The present invention relates to electrical connector assembly, more particularly to an electrical connector assembly adapted for electrically connecting an IC package to a printed circuit board.

2. Description of Related Art

Current electrical connector assembly, adapted for high speed signals transmitting between IC packages, comprises a first body mounted on the printed circuit board and a second body engaging with the first body and supporting the IC package. A heat sink is assembled above the IC package. The first body has a housing and a plurality of first contacts received in the housing, which are soldered on the printed circuit board via solder balls to electrically connect the first body and the printed circuit board. The second body has an insulative base and a plurality of second contacts received in the insulative base, which are soldered on the IC package via solder balls to electrically connect the second body and the IC package. And the first body electrically conducts with the second body so as to electrically connect the IC package and the printed circuit board. However, it is not easy to assemble the second body to the first body accurately, and the heat sink is easily dropped from the second body. The electrical connector assembly retains the heat sink by a lever, however, sometimes the lever is operated by a mistake and that causes the heat sink can not work normally.

An improved electrical connector assembly is desired.

BRIEF SUMMARY OF THE INVENTION

According to one aspect of the present invention, an electrical connector assembly, adapted for receiving an IC package, comprises a first connector, a second connector, a frame surrounding the first and the second connectors, a locking member and a lever. The second connector is mounted onto the first connector and used for receiving the IC package. The locking member has a main body, a supporting portion and an extending arm extending from two opposite ends of the main body, respectively, the main body defines a circular hole via which the locking member is pivotally assembled to the frame. The lever is pivotally assembled relative to the frame, the lever seats on the supporting portion of the locking member, so that a downwardly movement of the lever rotates the locking member and then the extending arm upwardly moves to apart the second connector from the first connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
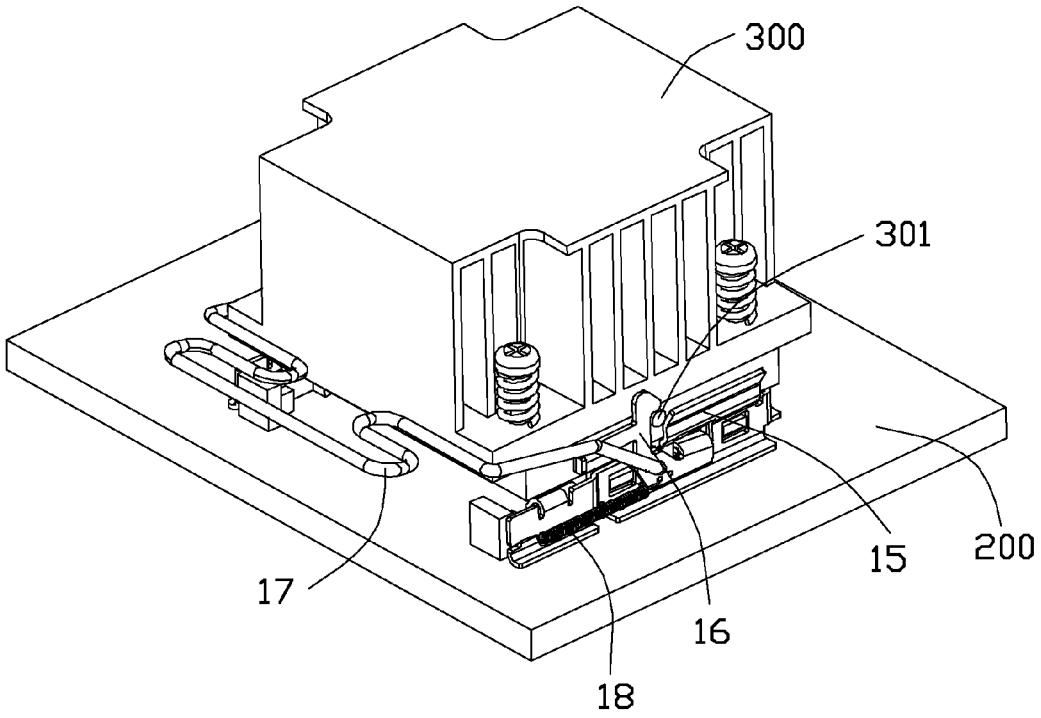
FIG. 1 is an assembled, perspective view of the electrical connector assembly mounted to a printed circuit board in accordance with present invention, and a heat sink is loaded on the electrical connector assembly.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

The electrical connector assembly 100 as show in FIGS. 1-6, is used for electrically connecting an IC package (not shown) to a printed circuit board 200. The IC package (not shown) is received in the electrical connector assembly 100, and a heat sink 300 is mounted above the IC package to disperse heats.

Figure 2:
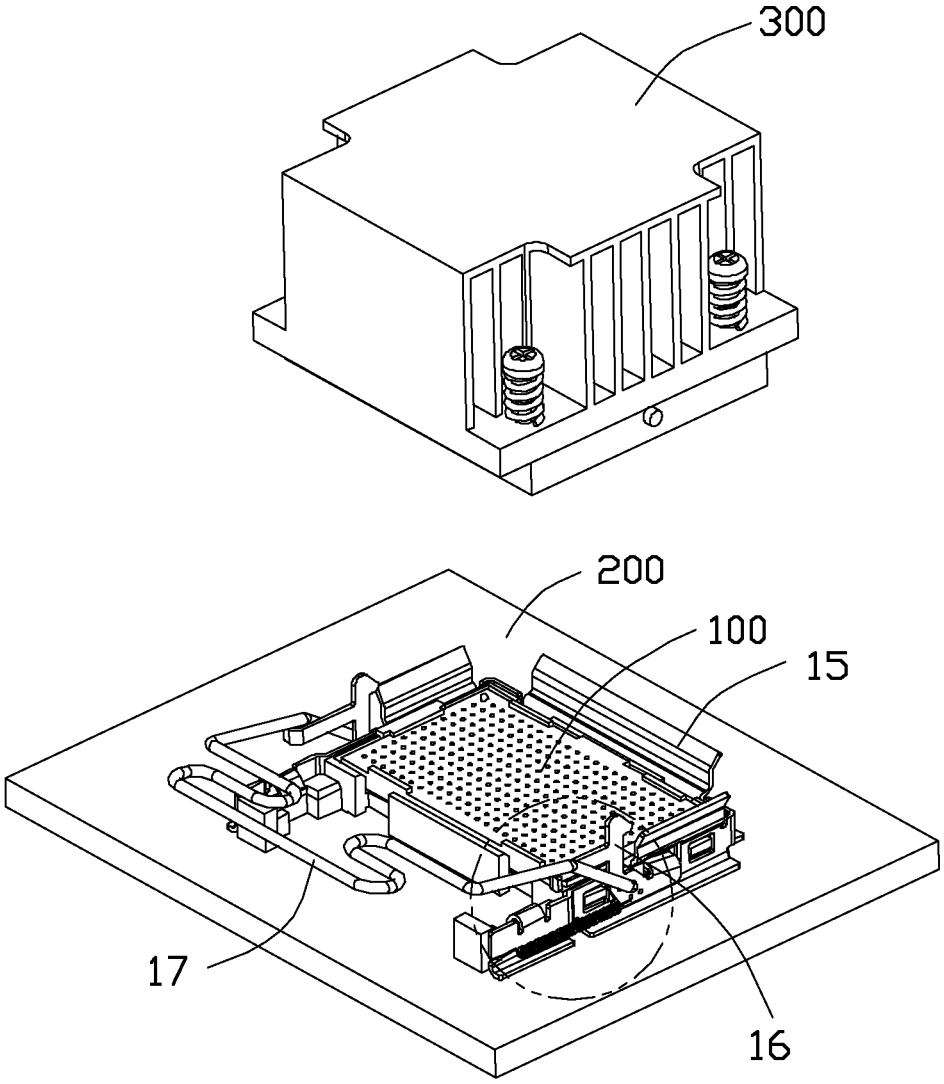
FIG. 2 is another assembled, perspective view of the electrical connector assembly similar with FIG. 1, wherein the heat sink is removed from the electrical connector assembly.
Figure 3:
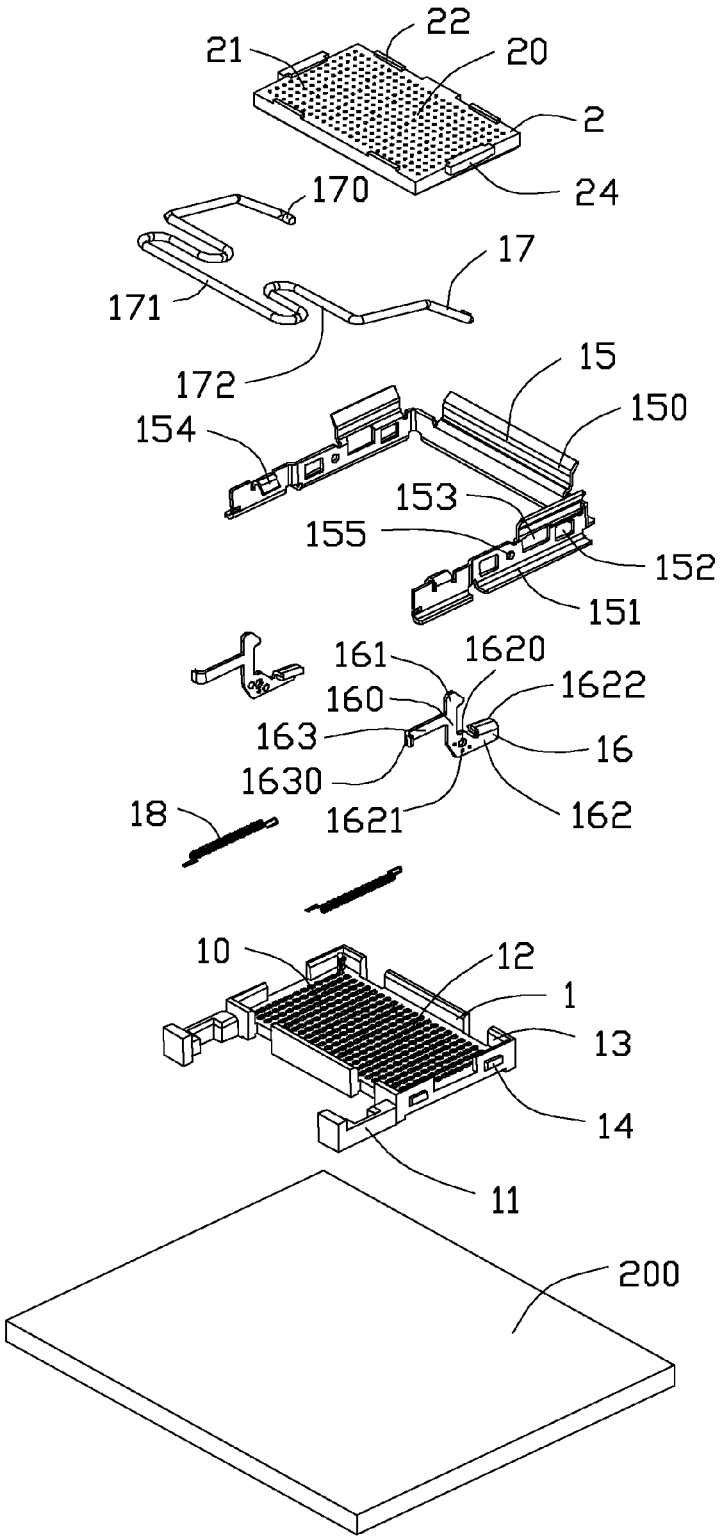
FIG. 3 is an explored, perspective view of the electrical connector assembly.

Referring to FIGS. 1-3, the electrical connector assembly 100 has a first connector 1 mounted to a printed circuit board 200, and a second connector 2 mounting onto the first connector 1, and a frame 15 surrounding the first and the second connectors 1, 2. The electrical connector assembly 100 further has a lever 17, two locking members 16 rotatablely assembled on two sides of the frame 15 via the lever 17 pivoting to the frame 15, and two springs 18 retained between the locking members 16 and the frame 15.

The first connector 1 has a longitudinal body 10, a plurality of receiving holes 12 passing through the body 10 along a top to bottom direction, a peripheral sidewall 13 extending upwardly from a peripheral of the body 10, a plurality of ribs 14 formed on an outside of the sidewall 13 and two protrusions 11 protruding outwardly from two opposite ends of a side of the side wall 13. A plurality of first contacts (not shown) are received in the receiving holes 12.

The second connector 2 defines a top surface for loading the IC package (not shown), has a longitudinal body 20, a plurality of receiving slots 21 passing through the body 20 along the top to bottom direction, and a plurality of positioning portions 22 and two clumps 24. The two clumps 24 protrude upwardly and outwardly from two opposite edges of the body 20, respectively, for positioning the IC package (not shown). The receiving slots 21 of the second connector 2 are aligned with corresponding receiving holes 12 of the first connector 1. A plurality of second contacts (not shown) are received in the receiving slots 21, and mates with the first contacts of the first connector 1.

The frame 15 is formed by metallic material and is a U shape. The frame 15 has a base 150 and two supporting arms 151 bent from two ends of the base 150. The supporting arm 151 defines two through holes 152 engaging with the ribs 14 of the first connector 10 to retain the frame 15 to the first connector 1. The supporting arm 151 further defines a slot 153 and a pivoting hole 155 between the two through holes 152. The pivoting hole 155 is defined for assembling the lever 17. The supporting arm 151 has a latching 154 bent from a top edge of a free end thereof and latching the protrusion 11 of the first connector 10.

The locking member 16 is cut from a metal material and has a main body 160, a claw 161 extending backwardly from a top of the main body 160, an extending arm 162 extending backwardly from a bottom of the main body 160 and a supporting portion 163 extending forwardly from the main body 160. The supporting portion 163 has a hook 1630 laterally bent from a front end thereof, the claw 161 and the supporting portion 163 are located on two opposite sides of the main body 160, and the extending arm 162 and the claw 161 are located on the same side of the main body 160. The main body 160 defines a circular hole 1620 through which the lever 17 passes through and a retaining hole 1621 latching with the spring 18. The extending arm 162 is formed with a pushing portion 1622 bent inwardly toward the first connector 1.

The lever 17 can force the supporting portion 163 downwardly rotate and bring the extending arm 162 to upwardly move. The lever 17 is made from a metallic pole, and has an operating portion 171, two pressing portions 172 bent rearward from two opposite ends of the operating portion 171 and two ends 170 bent inwardly from free ends of the pressing portions 172 and toward each other. The pressing portion 172 has a first part and a second part bent from the first part. The two ends 170 are inserted into the pivoting holes 155 to assemble the lever 17 to the frame 15.

Referring to FIGS. 2-3, when assemble the electrical connector assembly 100, firstly, solder the first connector 1 on the printed circuit board 200, and mount the second connector 2 upon the first connector 1, put the frame 15 around the connectors 1, 2, the ribs 14 of the first connector 1 are received in the through hole 152 of the frame 15. Then make the ends 170 of the lever 17 firstly pass through the circular hole 1620 of the locking member 16 and insert into the pivoting hole 155 of the frame 15 so as to assemble the locking members 16 and the lever 17 to two sides of an end of the frame 15, the pushing portion 1622 passes through the slot 153 of the frame 15 and arrives an underside of the clump 24 of the second connector 2. Next, latch one end of the spring 18 with the retaining hole 1621 of the locking member 16, and latch the other end of the spring 18 to a gap (not labeled) defined on a front end of the supporting arm 151 of the frame 15. Finally, the heat sink 300 is retained to a top of the second connector 2 by retainers.

Figure 4:
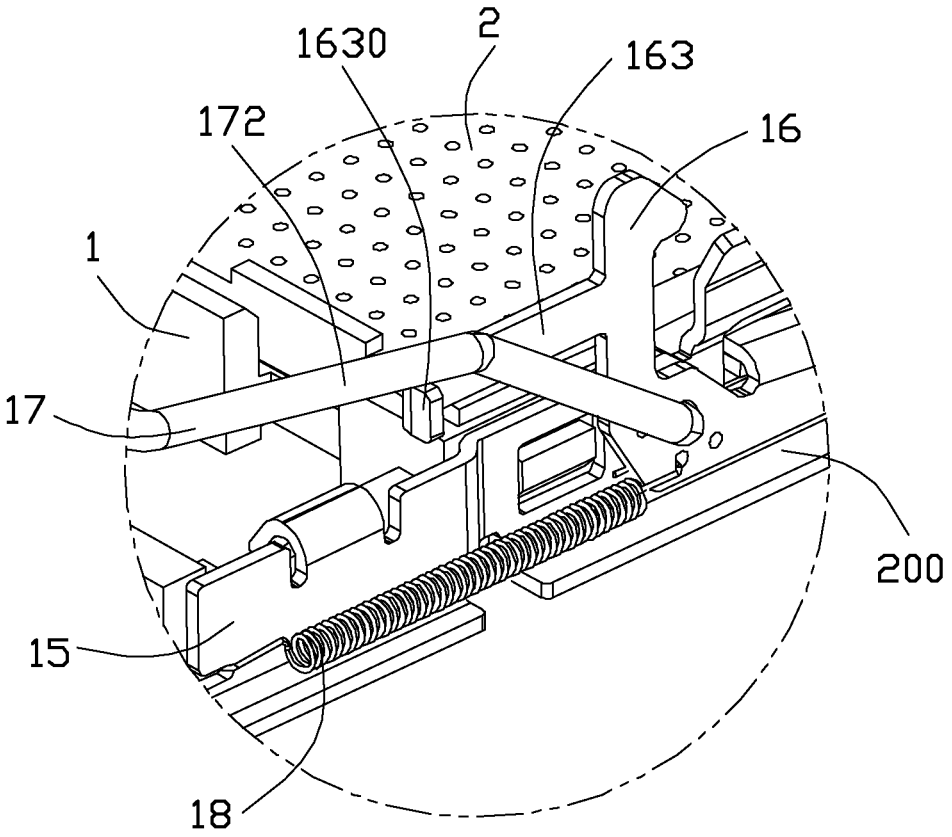
FIG. 4 is an enlarged view of a part of the electrical connector assembly in a circuit line of FIG. 2.
Figure 5:
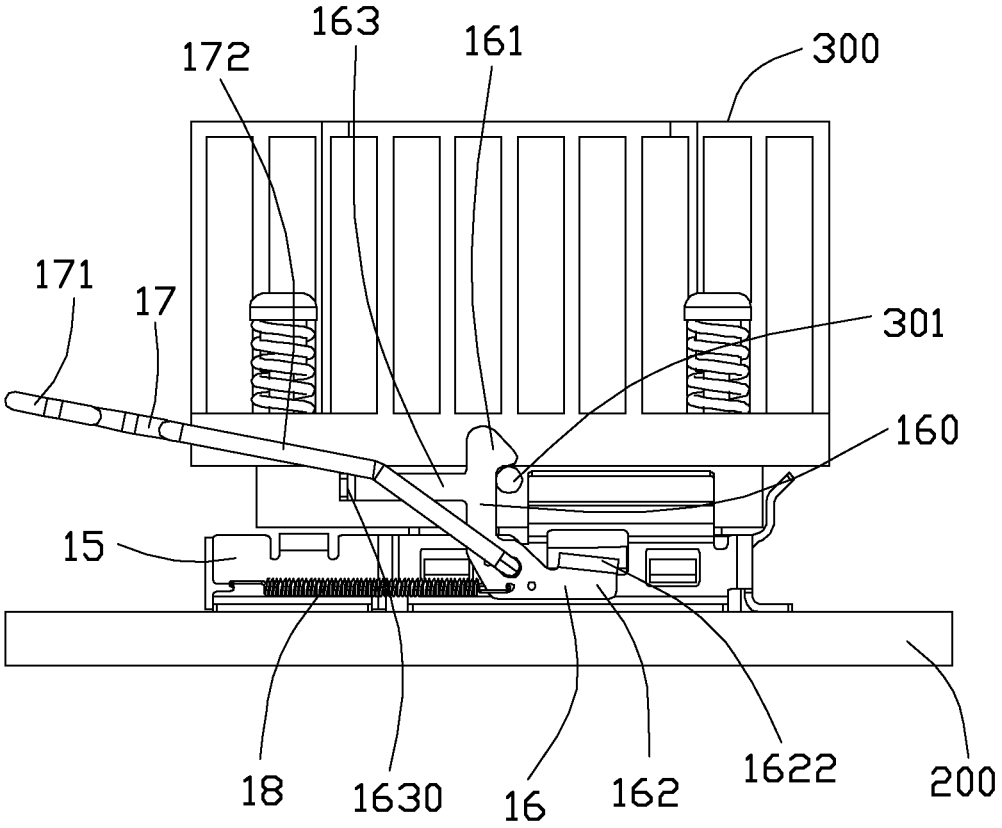
FIG. 5 is a side view of the electrical connector assembly with the heat sink in a closed status.
Figure 6:
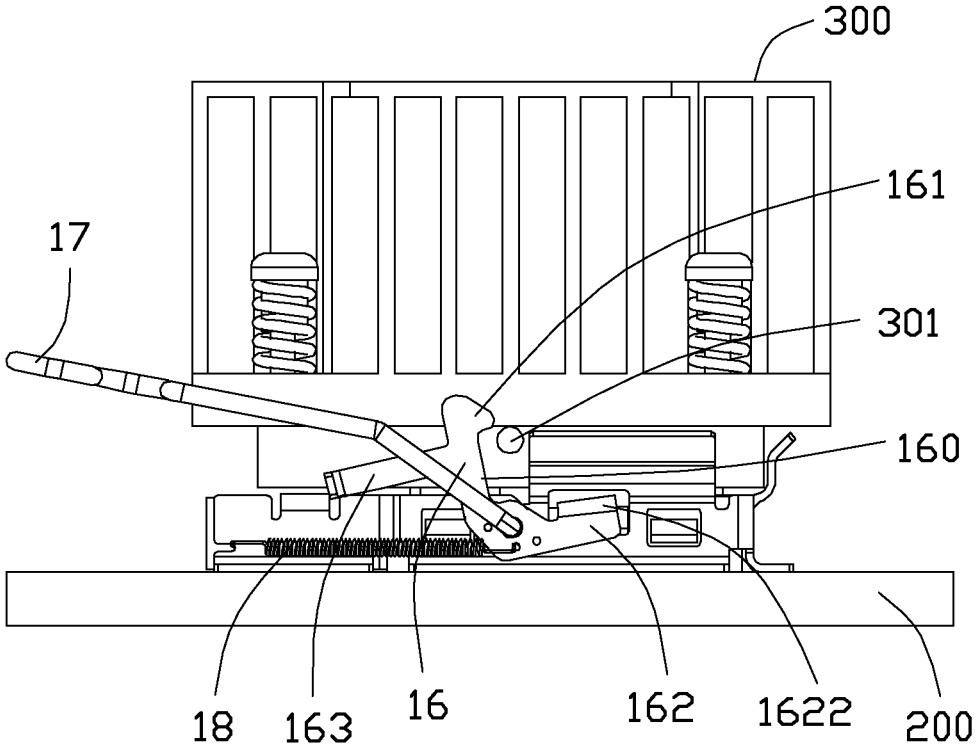
FIG. 6 is a side view of the electrical connector assembly with the heat sink in an open status.
Figure 7:
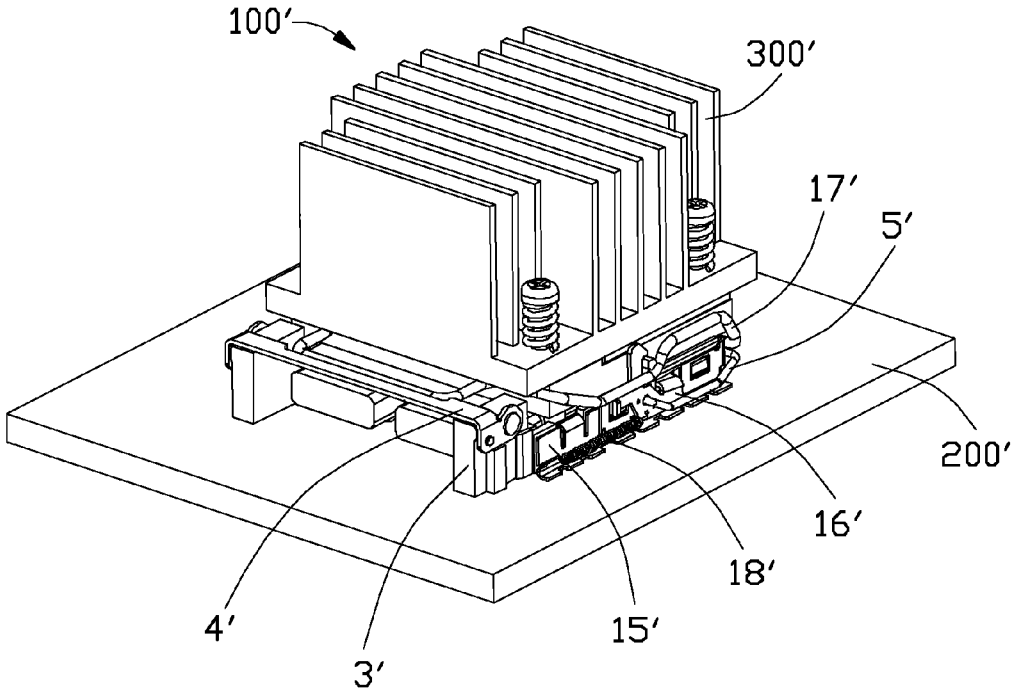
FIG. 7 is an assembled, perspective view of the electrical connector assembly mounted to a printed circuit board in an alternative embodiment in accordance with present invention, with a heat sink loaded on the electrical connector assembly.
Figure 8:
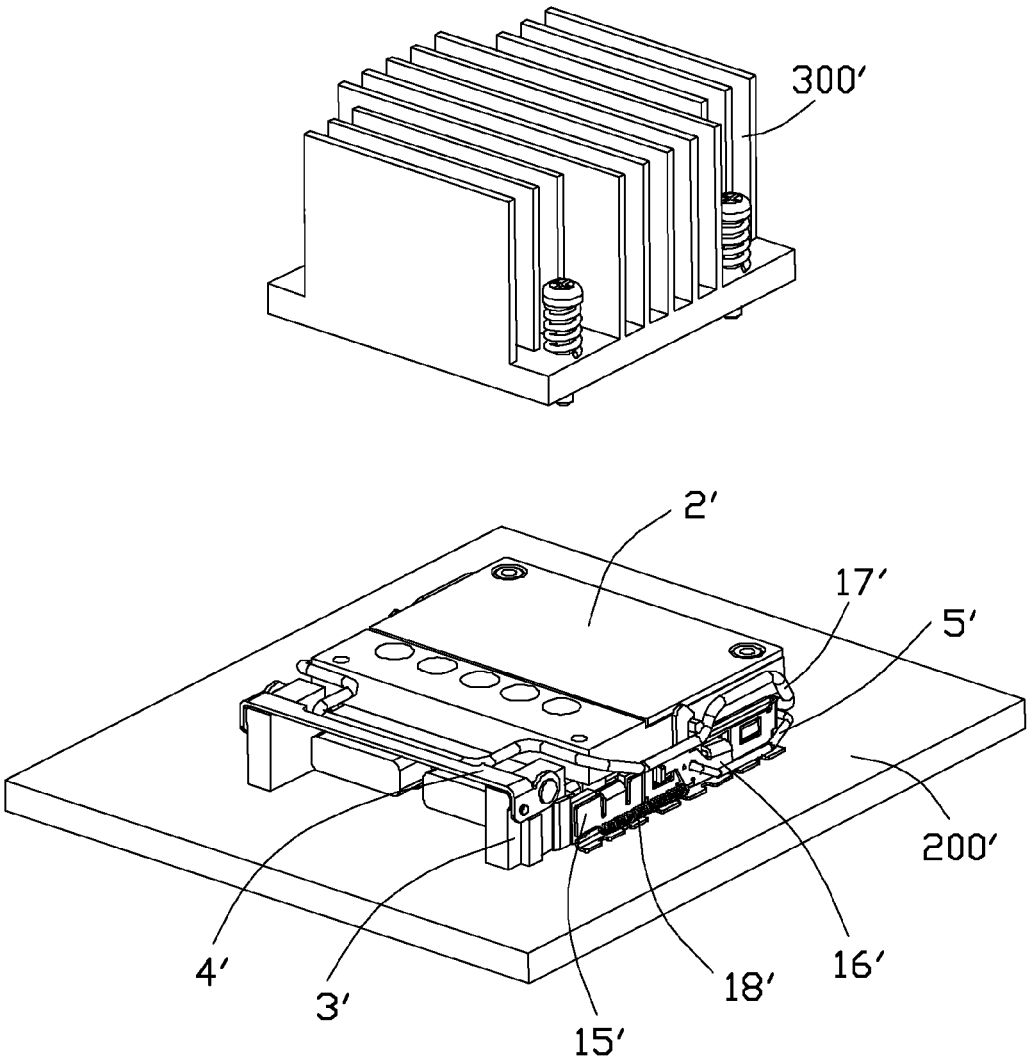
FIG. 8 is another assembled, perspective view of the electrical connector assembly in FIG. 7.

Referring to FIGS. 5-7, and conjoined with FIG. 4, when the electrical connector assembly 100 is at a closed status in FIG. 5, the pressing portion 172 seats on the hook 1630 of the supporting portion 163 of the locking member 16, the claw 161 of the locking member 16 locks a pole 301 formed on a side of the heat sink 300, the pushing portion 1622 is below the clump 24 of the second connector 2, the electrical connector assembly 100 at this status can work normally. When need to change the electrical connector assembly 100 from the closed status to an open status, downwardly press the operation portion 171 of the lever 17, and bring the pressing portion 172 to downwardly press the supporting portion 163, then cause the locking member 16 to rotate and release the pole 301 of the heat sink 300 from the claw 161; at the same time, the pushing member 1622 of the extending arm 162 upwardly push the clump 24 of the second connector 2 to apart the second connector 2 from the first connector 1. Finally, release the lever 17, the springs 18 force the locking members 16 to rotate back and then bring the lever 17 to restore.

FIGS. 7-11 show another electrical connector 100' in an alternative embodiment in accordance with present invention, the electrical connector 100' has a substantially same configuration with the electrical connector assembly 100 in above embodiment, and comprises a first connector 1' mounted to a printed circuit board 200', a modular 4' received in the first connector 1' and a second connector 2' mounting upon the first connector 1' and the modular 3', and a frame 15' surrounding the first, the second connector 1', 2' and the modular 3'. An IC package (not shown) is located in a top of the second connector 2' and a heat sink 300 is mounted upon the IC package. The electrical connector assembly 100' further has a protective frame 4' mounted to an end of the modular 3', a lever 17', two locking members 16' rotatablely assembled on two sides of the frame 15' via the lever 17' pivoting to the frame 15', two springs 18' retained between the locking members 16' and the frame 15', and a pivot haulm 5'.

Figure 9:
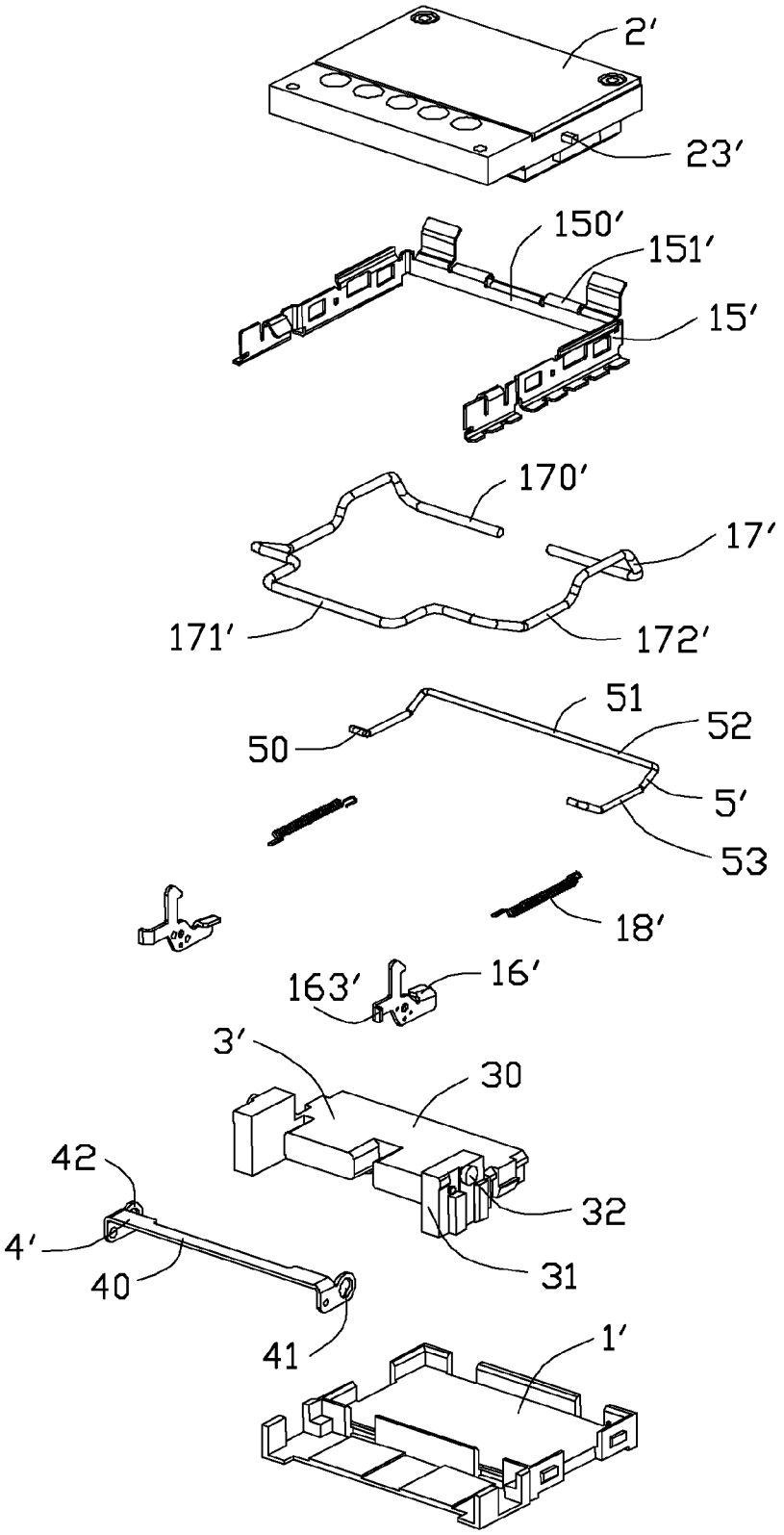
FIG. 9 is an explored, perspective view of the electrical connector assembly in FIG. 8.

Referring to FIG. 9, the first connector 1', the frame 15', the locking member 16', and the springs 18' of the electrical connector assembly 100' are respectively similar with the first connector 1, the frame 15, the locking member 16, and the springs 18 of the electrical connector assembly 100 in above embodiment, here will not more unnecessary description.

The modular 3' has a longitudinal body 30, an extending wall 31 extending upwardly from two sides of the body 30, and two poles 32 formed on an outside surface of the extending wall 31. The protective frame 4' is pivotally assembled to the modular 3 and has a cover 40 and two connecting portions 42 bent downwardly from two opposite ends of the cover 40, the connecting portion 42 defines a hole 41, which rings the pole 32 of the modular 3' to pivot the protective frame 4' to the modular 3'.

The haulm 5' has two ends 50 and a connecting portion 51 connecting the ends 50, the two ends 50 extend inwardly toward each other and pivot the haulm 5 to a rear side of the frame 15' opposite to the lever 17', and the connecting portion 51 has two side arms 53 connecting with the ends 50 respectively, and a connecting part 52 connecting the two side arms. The frame 15' has a main body 150', a clasp 151' is bent rearward and downwardly from a top edge of the main body 150' to define a receiving space (not labeled) with the main body 150'. The connecting part 52 of the haulm 5' is assembled in the receiving space. A horizontal part of the side arm 53 of the haulm 5' seats on a bottom wings (not labeled) extending from the frame 15', so the haulm 5' is in a balanced status.

The lever 17' has two pivoting ends 170' inwardly extending toward each other, two pressing portions 172' connecting with the two pivoting ends 170' respectively, and an operating portion 171' connecting the two pressing portions 172'. The pivoting end 170' is also received in the receiving space (not labeled) of the frame 15' and is limited by the clasp 151' of the frame 15' and the connecting part 52 of the haulm 5', by this arrangement, the lever 17' can rotate around the pivoting ends 170'.

Figure 10:
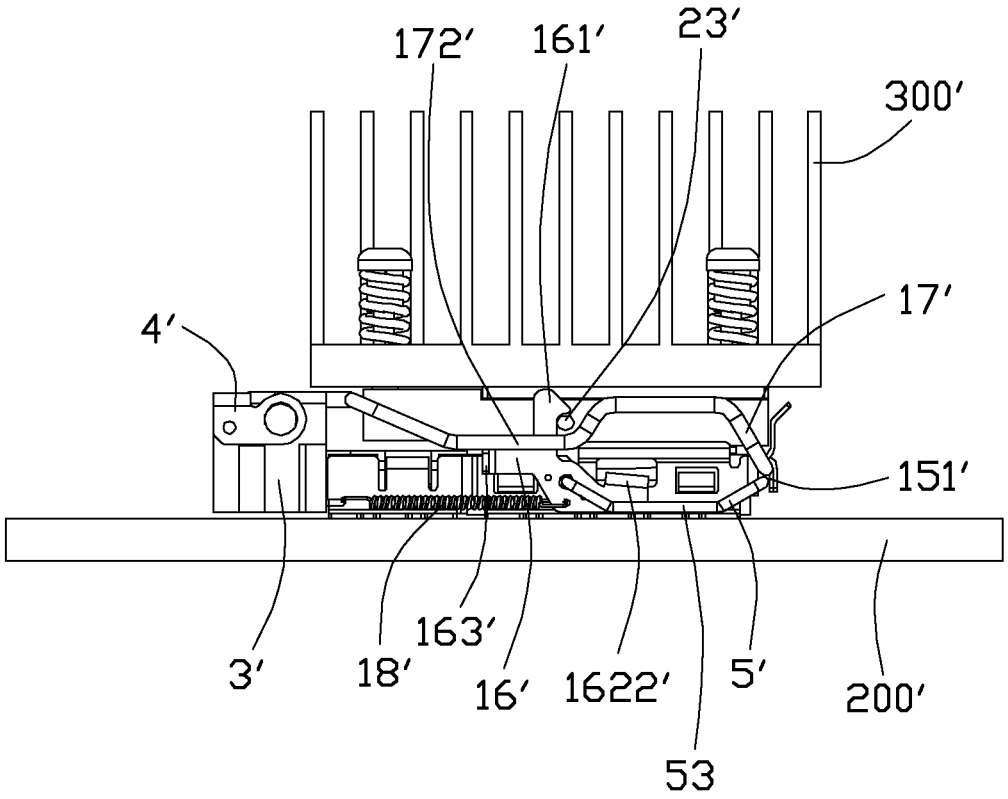
FIG. 10 is a side view of the electrical connector assembly with the heat sink in FIG. 8, showing a closed status.
Figure 11:
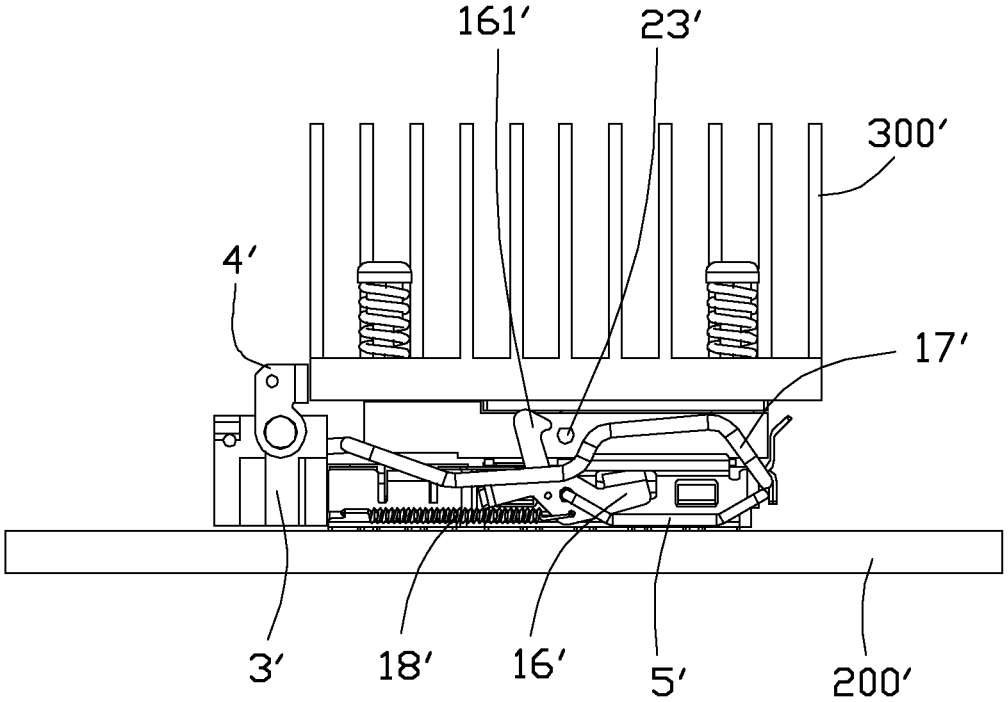
FIG. 11 is similar with FIG. 10, but showing an open status.

Referring to FIGS. 10 and 11, when assemble the electrical connector assembly 100', firstly, solder the first connector 1' on the printed circuit board 200', put the modular 3' in the first connector 1' and mount the second connector 2' upon the first connector 1' and the modular 3', put the frame 15' around the connectors 1', 2', assemble the protective frame 4' to the modular 3'. Then put the connecting part 52 of the haulm 5' in the receiving space of the frame 15', and make the ends 50 of the haulm 5' pass through the locking member 16' and insert into a hole (not labeled) of the frame 15' so as to assemble the locking members 16' to the frame 15'. A claw 161' of the locking member 16' locks with a pole 23' formed on an outside of the second connector 2', so that the locking member 16' retains the second connector 2'.

Next, assemble the lever 17' to the frame 15', the ends 170' are received in the receiving space of the frame 15' and supported by the connecting part 52 of the haulm 5', and the pressing portion 172' seats on the hook 163' of the locking member 16'; latch one end of the spring 18' with the locking member 16', and latch the other end of the spring 18' to a gap (not labeled) defined on a front end of the frame 15'. Finally, the heat sink 300' is retained to a top of the second connector 2' by retainers.

Referring to FIGS. 7, 10 and 11, when the electrical connector assembly 100 is at a closed status in FIG. 10, wherein the pressing portion 172' seats on the hook 163' of the locking member 16', a claw 161' of the locking member 16' locks the pole 23' of the second connector 2', the electrical connector assembly 100' at this status can work normally. When need to open the electrical connector assembly 100', upwardly rotate the protective frame 4' so as to have a space to downwardly operate the operation portion 171' of the lever 17' to rotate around the ends 170'; then the pressing portion 172' downwardly presses the hook 163', and causes the locking member 16' rotates to release the pole 23' of the second connector 2'; at the same time, a pushing member 1622' of the locking member 16' upwardly pushes the second connector 2' to apart the second connector 2' from the first connector 1' and the modular 3, so the heat sink 300' is easily taken away, this point is similar as that in the electrical connector assembly. Release the lever 17', the springs 18' force the locking members 16' to rotate back and then bring the lever 17' to restore.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, adapted for receiving an IC package, comprising:

a first connector and a second connector mounted onto the first connector and used for receiving the IC package;

a frame surrounding the first and the second connectors;

a locking member having a main body, a supporting portion and an extending arm extending from two opposite ends of the main body, respectively, the main body defining a circular hole via which the locking member is pivotally assembled to the frame; and a lever pivotally assembled relative to the frame, the lever seating on the supporting portion of the locking member, so that a downwardly movement of the lever rotates the locking member and then the extending arm upwardly moves to lift up and separate the second connector from the first connector.

2. The electrical connector assembly as claimed in claim 1, further comprising a heat sink mounted upon the IC package received in the second connector, and the locking member further has a claw locking the heat sink.

3. The electrical connector assembly as claimed in claim 1, wherein the extending arm of the locking arm has a pushing portion inwardly bent therefrom, said second connector is formed with a clump, and the pushing portion upwardly pushes the clump to lift the second connector.

4. The electrical connector assembly as claimed in claim 3, wherein the lever has an operating portion, two pressing portions bent rearward from two opposite ends of the operating portion and two ends bent inwardly from free ends of the pressing portions and toward each other.

5. The electrical connector assembly as claimed in claim 3, wherein the end of the lever passes through the circular hole of the locking member and inserts into a pivoting hole defined on the frame so as to pivot the locking member to the frame.

6. The electrical connector assembly as claimed in claim 4, further comprising a spring disposed between the locking member and the frame.

7. The electrical connector assembly as claimed in claim 4, further comprises a haulm, and an end of the haulm passes through the circular hole of the locking member and pivots the locking member to the frame.

8. The electrical connector assembly as claimed in claim 7, wherein the haulm is supported by the frame reliably, and the frame defines a receiving space at a rear end thereof, an opposite end of the haulm is away from the circular hole and is received in the receiving space.

9. The electrical connector assembly as claimed in claim 8, wherein the end of the lever is received in the receiving space and limited by the opposite end of the haulm, so that the lever can rotate around the end thereof.

10. An electrical connector assembly, adapted for engaging with a mating connector assembly, comprising:

a first connector for mating with the mating connector assembly;

a frame surrounding the first connector; and a locking mechanism disposed onto the assembly, the locking mechanism having a locking member and a lever, which are both movably assembled to the frame, the locking member having a main body, a supporting portion extending forwardly from the main body and an extending arm extending rearward from the main body; wherein the lever moves downwardly and force the locking member to rotate and then the extending arm moves upwardly for lifting the locking mating connector assembly.

11. The electrical connector assembly as claimed in claim 10, wherein the lever seats on the supporting portion of the locking member.

12. The electrical connector assembly as claimed in claim 11, wherein the extending arm has a pushing portion extending rearward from the main body, the mating connector assembly has a second connector with a clump, the pushing portion upwardly pushes the clump to lift the mating connector assembly.

13. The electrical connector assembly as claimed in claim 11, wherein the lever passes through the locking member to pivot the locking member and itself to the frame.

14. The electrical connector assembly as claimed in claim 11, further comprises a haulm pivot the locking member to the frame.

15. An electrical connector assembly comprising:

a printed circuit board;

an electrical connector assembly mounted upon the printed circuit board;

a metallic frame mounted upon the printed circuit board and surrounding the electrical connector assembly;

an electronic package seated upon the electrical connector assembly;

a heat sink seated upon the electronic package;

a locking pole formed on either the heat sink or the electrical connector assembly;

a locking member pivotally, between locking and unlocking positions, mounted upon the frame with a first section engaged with the locking pole and a second section urged by a spring to have said first section engaged with the locking pole at said locking position; and an operation lever mounted to the frame and up and down moveable relative to the frame to actuate said locking member to pivotally move from the locking position to the unlocking position for unlocking said locking pole.

16. The electrical connector assembly as claimed in claim 15, wherein said operation lever is pivotally moveable relative to the frame.

17. The electrical connector assembly as claimed in claim 16, wherein said locking member includes a supporting portion intimately upwardly confronting the operation lever.

18. The electrical connector assembly as claimed in claim 16, wherein the locking pole is formed upon the heat sink when the heat sink is not secured to the electrical connector assembly; the locking pole is formed on the electrical connector assembly when the heat sink is secured to the electrical connector assembly via a plurality of screws equipped with corresponding coil springs.

19. The electrical connector assembly as claimed in claim 16, wherein said locking member further includes a pushing portion to upward eject the heat sink away from the locking position.

* * * * *